US008490969B2

(12) United States Patent
Sawamura et al.

(10) Patent No.: US 8,490,969 B2
(45) Date of Patent: Jul. 23, 2013

(54) CONVEYANCE DEVICE AND IMAGE FORMING APPARATUS

(75) Inventors: Jun Sawamura, Yokohama (JP); Hideki Sato, Yokohama (JP); Hiroshi Kon, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/116,815

(22) Filed: May 26, 2011

(65) Prior Publication Data

US 2012/0153567 A1 Jun. 21, 2012

(30) Foreign Application Priority Data

Dec. 17, 2010 (JP) ..... 2010-281643

(51) Int. Cl.
*B65H 5/06* (2006.01)
*B65H 31/00* (2006.01)

(52) U.S. Cl.
USPC ..... 271/274; 271/272; 271/207

(58) Field of Classification Search
USPC ..... 271/272, 273, 274
See application file for complete search history.

(56) References Cited

U.S. PATENT DOCUMENTS

| | | | | |
|---|---|---|---|---|
| 5,988,635 | A * | 11/1999 | Ohshima | 271/274 |
| 7,200,356 | B2 * | 4/2007 | Kawamoto | 399/405 |
| 8,025,292 | B2 * | 9/2011 | Takeshita | 271/274 |
| 2004/0245715 | A1 * | 12/2004 | Zheng | 271/274 |
| 2005/0012264 | A1 * | 1/2005 | Morrison et al. | 271/274 |
| 2006/0071422 | A1 * | 4/2006 | Klein et al. | 271/274 |
| 2007/0018387 | A1 * | 1/2007 | Yamamoto | 271/272 |
| 2007/0069456 | A1 * | 3/2007 | Jeong | 271/272 |
| 2008/0036141 | A1 * | 2/2008 | Liu et al. | 271/274 |
| 2008/0042340 | A1 * | 2/2008 | Linder et al. | 271/274 |

FOREIGN PATENT DOCUMENTS

| | | |
|---|---|---|
| JP | 2001-019209 A | 1/2001 |
| JP | 2002-316740 A | 10/2002 |

* cited by examiner

*Primary Examiner* — Kaitlin Joerger
(74) *Attorney, Agent, or Firm* — Sughrue Mion, PLLC

(57) ABSTRACT

A conveyance device includes: a rotary member that rotates; a driven member that rotates in accordance with the rotary member and conveys a conveyed material while holding the conveyed material between the driven member and the rotary member; a guide part provided on an upstream side from a rotary shaft of the driven member in a conveyance direction of the conveyed material, that guides the driven member toward the rotary member; and a support member that brings the rotary shaft of the driven member into contact with the guide part, and along with the guide part, supports the rotary shaft.

7 Claims, 14 Drawing Sheets

CONVEYANCE DEVICE AND IMAGE FORMING APPARATUS

CROSS-REFERENCE TO RELATED APPLICATION

This application is based on and claims priority under 35 USC 119 from Japanese Patent Application No. 2010-281643 filed Dec. 17, 2010.

BACKGROUND

Technical Field

The present invention relates to a conveyance device and an image forming apparatus.

SUMMARY

According to an aspect of the present invention, there is provided a conveyance device including: a rotary member that rotates; a driven member that rotates in accordance with the rotary member and conveys a conveyed material while holding the conveyed material between the driven member and the rotary member; a guide part, provided on an upstream side from a rotary shaft of the driven member in a conveyance direction of the conveyed material, that guides the driven member toward the rotary member; and a support member that brings the rotary shaft of the driven member into contact with the guide part, and along with the guide part, supports the rotary shaft.

BRIEF DESCRIPTION OF THE DRAWINGS

Exemplary embodiments of the present invention will be described in detail based on the following figures, wherein.

DETAILED DESCRIPTION

Next, exemplary embodiments of the present invention will be described based on the drawings.

Figure 1:
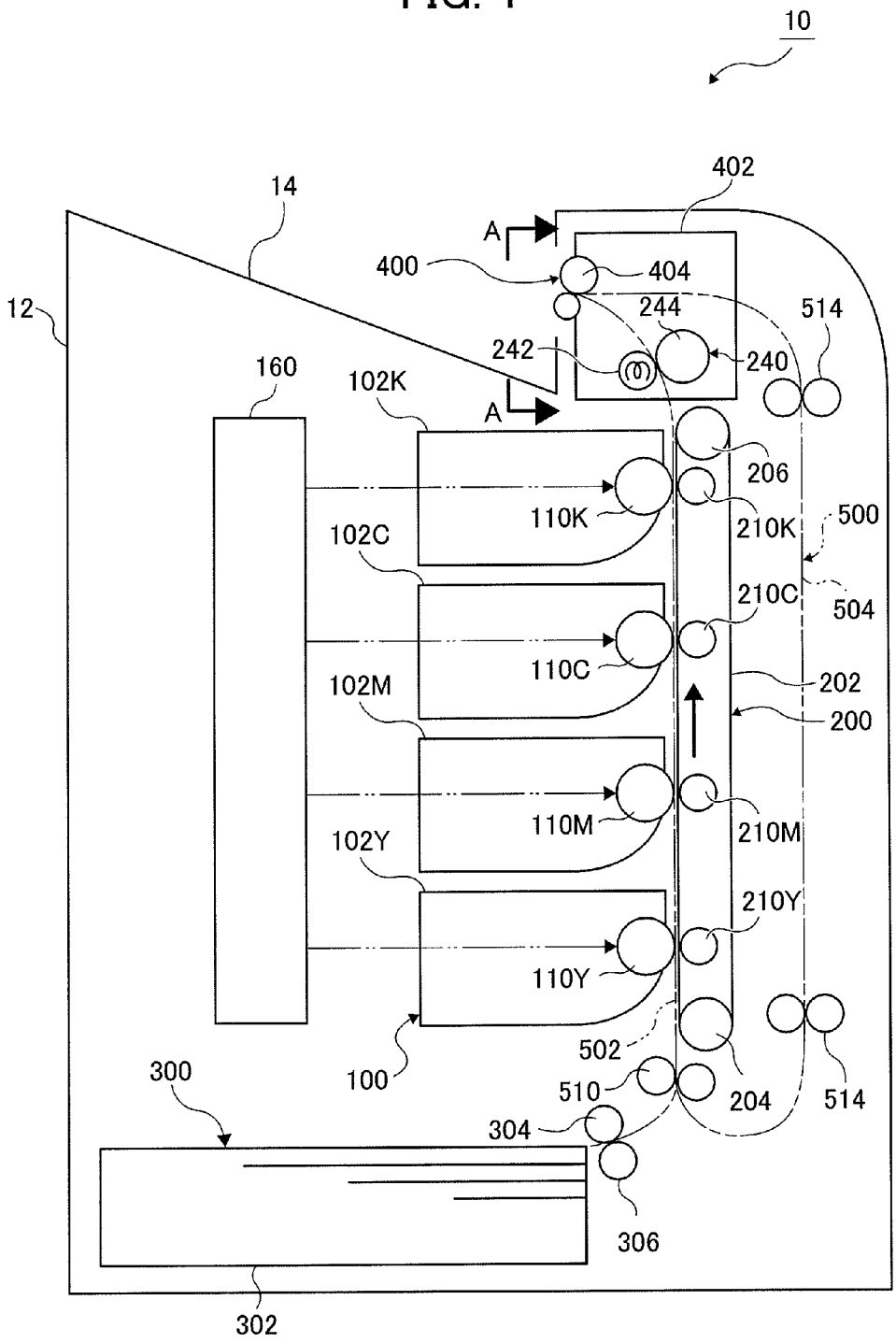
FIG. 1 is a cross-sectional view of an image forming apparatus according to a first exemplary embodiment of the present invention viewed from the left side.

FIG. 1 shows an image forming apparatus 10 according to a first exemplary embodiment of the present invention. The image forming apparatus 10 has an image forming apparatus main body 12. An image forming part 100, a transfer device 200, a fixing device 240, a paper feed device 300 and a conveyance device 400 are provided in the image forming apparatus main body 12. Further, an upper part of the image forming apparatus main body 12 is used as a discharge part 14. A print sheet which is an example of conveyed material and which is used as a recording medium is discharged to the discharge part 14. A conveyance passage 500, used for conveyance of the print sheet, is formed in the image forming apparatus main body 12.

A print sheet, which has passed through a contact position N (see FIG. 3) to be described later where a driving roller 404 to be described later and a driven roller 420 to be described later (see FIG. 3) are in contact with each other, is discharged to the discharge part 14.

The image forming part 100 forms a color image by an electrophotographic process. The image forming part 100 has four image forming structures 102Y, 102M, 102C and 102K having photoreceptors 110Y, 110M, 110C and 110K respectively in a cylindrical shape used as image holders, and a latent image forming device 160.

The latent image forming device 160, which is a laser exposure device, emits a laser beam corresponding to an yellow image to the photoreceptor 110Y; a laser beam corresponding to a magenta image to the photoreceptor 110M; a laser beam corresponding to a cyan image to the photoreceptor 110C; and a laser beam corresponding to a black image to the photoreceptor 110K, to form electrostatic latent images on the photoreceptors 110Y, 110M, 110C and 110K.

The transfer device 200 transfers a yellow developer image, a magenta developer image, a cyan developer image and a black developer image formed on the photoreceptors 110Y, 110M, 110C and 110K to a print sheet. The transfer device 200 has a sheet conveyance member 202 and transfer rollers 210Y, 210M, 210C and 210K. The sheet conveyance member 202, having an endless belt shape, holds a print sheet by electrostatic attraction, and conveys the held print sheet. The sheet conveyance member 202 is supported with two support rollers 204 and 206. At least one of the support rollers 204 and 206 is used as a driving roller to transmit driving to the sheet conveyance member 202, to rotate the sheet conveyance member 202 in an arrow direction shown in FIG. 1.

The transfer rollers 210Y, 210M, 210C and 210K are provided inside the sheet conveyance member 202, to be opposite to the photoreceptors 110Y, 110M, 110C and 110K via the sheet conveyance member 202. A transfer bias is applied to the respective transfer rollers, and the transfer rollers sequentially transfer the developer images formed on the photoreceptors 110Y, 110M, 110C and 110K to a print sheet being conveyed with the sheet conveyance member 202, to form a developer image, by overlaying the yellow developer image, the magenta developer image, the cyan developer image and the black developer image, on the print sheet.

The fixing device 240 has a heating roller 242 including a heating source and a pressure roller 244, and heats and pressurizes the developers transferred to the print sheet at a contact point between the heating roller 242 and the pressure roller 244, to fix the developer image to the print sheet.

The paper feed device 300 supplies sheets to the image forming part 100 and the transfer device 200. The paper feed device 300 has a sheet container 302. The sheet container 302 contains the sheets in a stacked state. The sheet container 302 can be pulled out to the front side or removed with respect to the image forming apparatus main body 12.

Further, the paper feed device 300 has a feed roller 304 to feed the sheet from the sheet container 302, and a multi-feed preventing member 306 in a roll shape, provided in contact with the feed roller 304, to retard the sheet from the sheet container 302 so as to prevent feeding of plural sheets in an overlaid state.

The conveyance device 400 is used as a conveyance device to convey at least one of a print sheet discharged from the image forming part 100 and a print sheet supplied to the image forming part 100. The conveyance device 400 has a conveyance device main body 402 and a driving roller 404 attached to the conveyance device main body 402.

The fixing device 240 is attached to the conveyance device main body 402.

The driving roller 404 is used as a rotary member which is forward/reverse rotatable. The rotational direction of the driving roller 404 is selected from a direction to discharge a print sheet to the discharge part 14 and a direction to pull a print sheet from the discharge part 14 side. That is, the conveyance device 400 conveys the print sheet in both the direction to discharge the print sheet to the discharge part 14 and the direction to pull the print sheet from the discharge part 14 side.

The conveyance passage 500 has a main conveyance passage 502 and a reversing conveyance passage 504. The main conveyance passage 502 is a conveyance passage to convey a print sheet from the paper feed device 300 toward the transfer device 200, and further convey the print sheet from the transfer device 200 to the discharge part 14. The above-described paper feed device 300, a registration roller 510, the above-described transfer device 200, the above-described fixing device 240 and the above-described driving roller 404 are provided along the main conveyance passage 502, sequentially from the upstream side in the sheet conveyance direction.

The registration roller 510 temporarily stops movement of the end of the print sheet conveyed toward the transfer device 200 side, and restarts the movement of the end of the print sheet toward the transfer device 200 in accordance with timing of formation of developer images on the photoreceptors 110Y, 110M, 110C and 110K.

The reversing conveyance passage 504 is a conveyance passage, used for reversal of a print sheet where an image is formed on one surface, to convey a print sheet from the driving roller 404 to the upstream side of the registration roller 510. Along the reversing conveyance passage 504, two reverse conveyance rollers 514 are provided.

In the print sheet where the image is formed on one surface, when another image is formed on the other surface, the driving roller 404 is rotated in a direction to supply the print sheet to the reversing conveyance passage 504 in a status where the driving roller 404 is in contact with the rear end of the print sheet where the image is formed, then the print sheet is supplied by the rotation to the reversing conveyance passage 504 from its rear end side, and the supplied print sheet is conveyed with the reverse conveyance rollers 514 to the upstream side of the registration roller 510.

Figure 2:
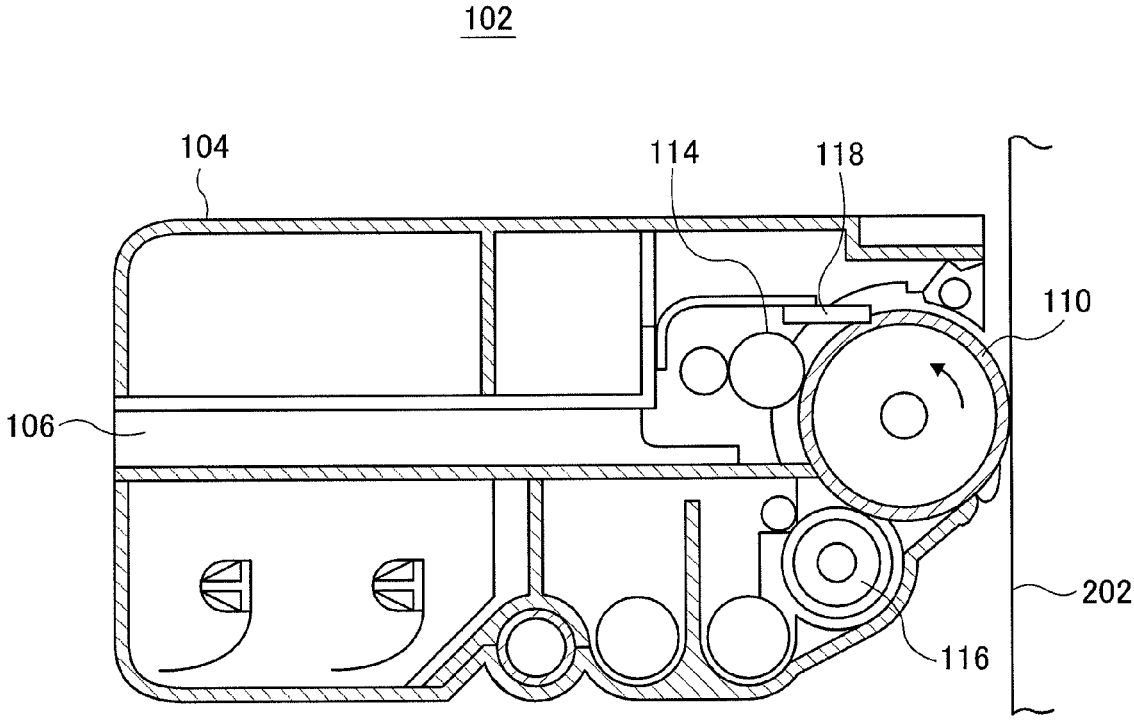
FIG. 2 is a cross-sectional view of an image forming structure of the image forming apparatus shown in FIG. 1 viewed from the left side.

FIG. 2 shows the image forming structure 102.

The image forming structures 102Y, 102M, 102C and 102K form developer images with different color developers, but have the same structure. Hereinbelow, the general designation "image forming structure 102" will be used. As shown in FIG. 2, the image forming structure 102 has an image forming structure main body 104. The above-described photoreceptor 110, a charging device 114 to uniformly charge the photoreceptor 110, a developing device 116 to develop a latent image formed with the latent image forming device 160 (see FIG. 1) on the photoreceptor 110 using a developer, and a cleaning device 118 to clean the developer or the like remaining on the photoreceptor 110 after the transfer of the developer image with the transfer device 200 (see FIG. 1) are provided in the image forming structure main body 104.

In the image forming structure main body 104, a laser beam path 106 is formed from an end in a horizontal direction to a position in the vicinity of the other end. A laser beam emitted from the latent image forming device 160 arrives at the photoreceptor 110 through the laser beam path 106.

Figure 3:
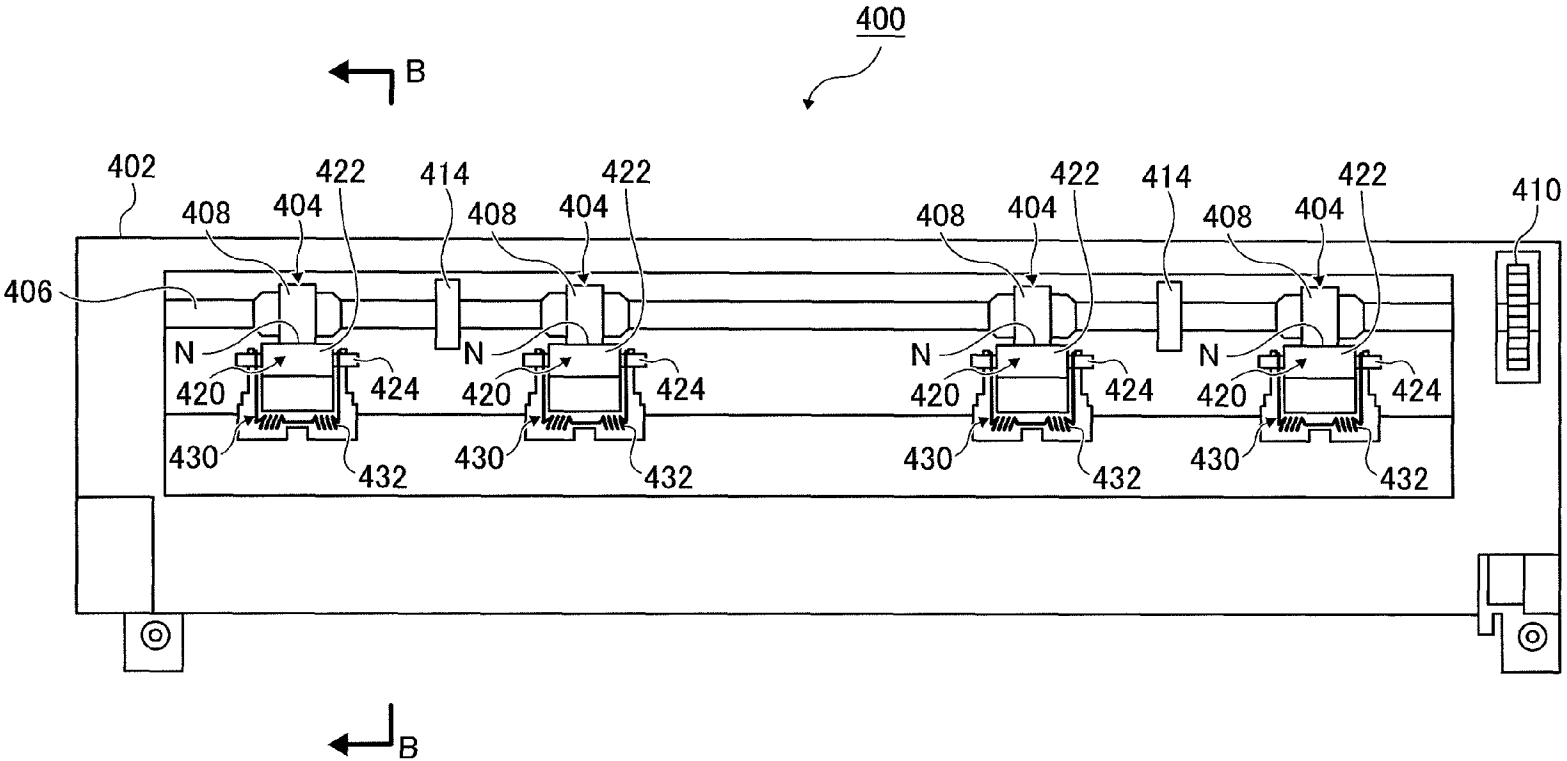
FIG. 3 is a rear view of a conveyance device of the image forming apparatus shown in FIG. 1 viewed from an arrow A-A direction in FIG. 1.

FIG. 3 shows the conveyance device 400. As shown in FIG. 3, the conveyance device 400 has the above-described conveyance device main body 402 and the above-described driving roller 404, further has a driven roller 420 to be in contact with the driving roller 404 in the contact position N and a pressing mechanism 430.

The driving roller 404 has a rotary shaft 406 and four rollers 408 attached to the rotary shaft 406. The rotary shaft 406 is rotatably supported with the conveyance device main body 402, and a drive transmission member 410 such as a gear is attached to the rotary shaft. The rotary shaft 406 is rotated with driving transmitted from a driving source such as a motor via a drive transmission member 410. Further, in the rotary shaft 406, two unevenness forming rollers 414 are attached in a position between adjacent rollers 408.

The unevenness forming rollers 414 are used as unevenness forming parts to form unevenness in a print sheet in the sheet conveyance direction. The unevenness forming rollers 414 form unevenness in the sheet conveyance direction in a print sheet passing through the contact position N. The rotary shaft 406, the four rollers 408 and the two unevenness forming rollers 408 are integrally rotated.

The driven roller 420 is used as an example of a driven member which is rotated in accordance with rotation of the driving roller 404, and which conveys a print sheet while holding the print sheet between the driven roller 420 and the driving roller 404. Further, in the present exemplary embodiment, the driven roller 420 is provided in four positions corresponding to the number of the rollers 408 of the driving roller 404. The driven rollers 420 respectively have a roller 422 and a shaft 424. The roller 422 and the shaft 424 are integrally rotated in accordance with the driving roller 404. The roller 422 is in contact with the respective rollers 408 in the contact position N.

In the present exemplary embodiment, the number of the pressing mechanisms 430 is four in correspondence with the number of the rollers 408 of the driving roller 404 and the number of the driven roller 420. The pressing mechanisms 430 respectively have a torsion coil spring 432. The torsion coil spring 432 is used as a spring and as a pressing member, and further used as an example of a pressing member to press the driven roller 420 against the driving roller 404 and a guide surface 462 (see FIG. 8) to be described later. Further, the torsion coil spring 432 is used as an example of a support member to support the driven roller 420. The torsion coil spring 432 brings the shaft 424 of the driven roller 420 into contact with the guide surface 462 (see FIG. 6) to be described later and supports the shaft 424 along with the guide surface 462.

Figure 4:
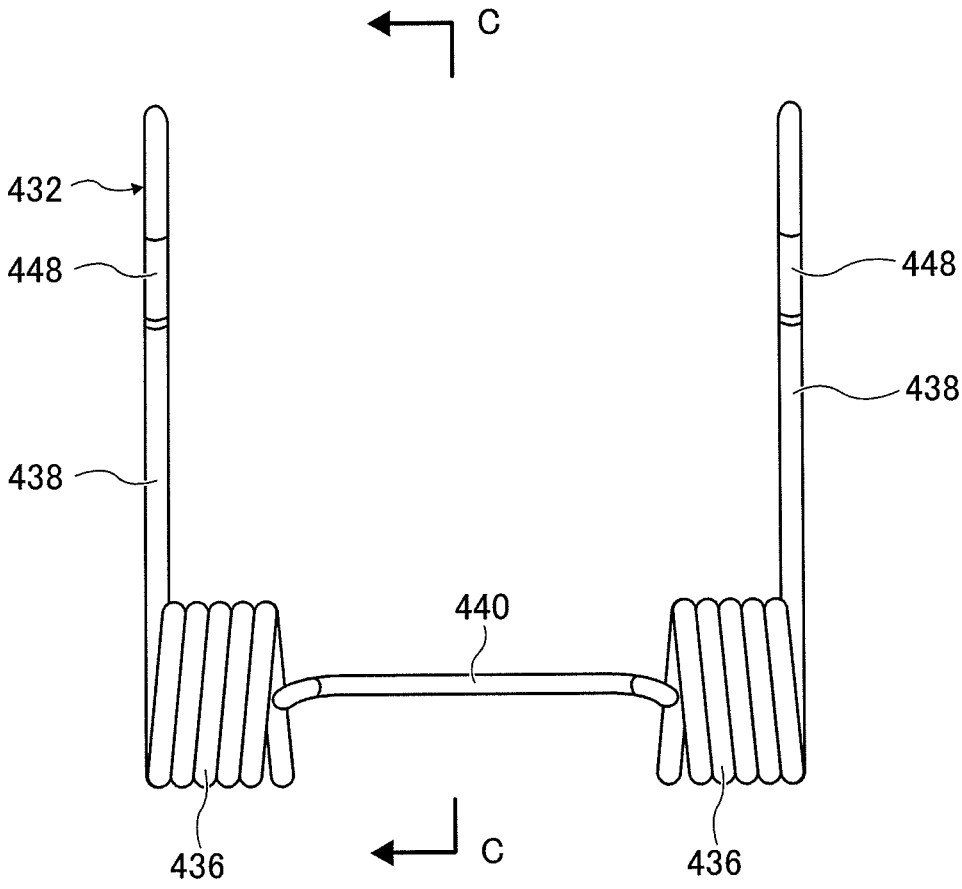
FIG. 4 is a rear view of a torsion coil spring of the conveyance device shown in FIG. 3.
Figure 5:
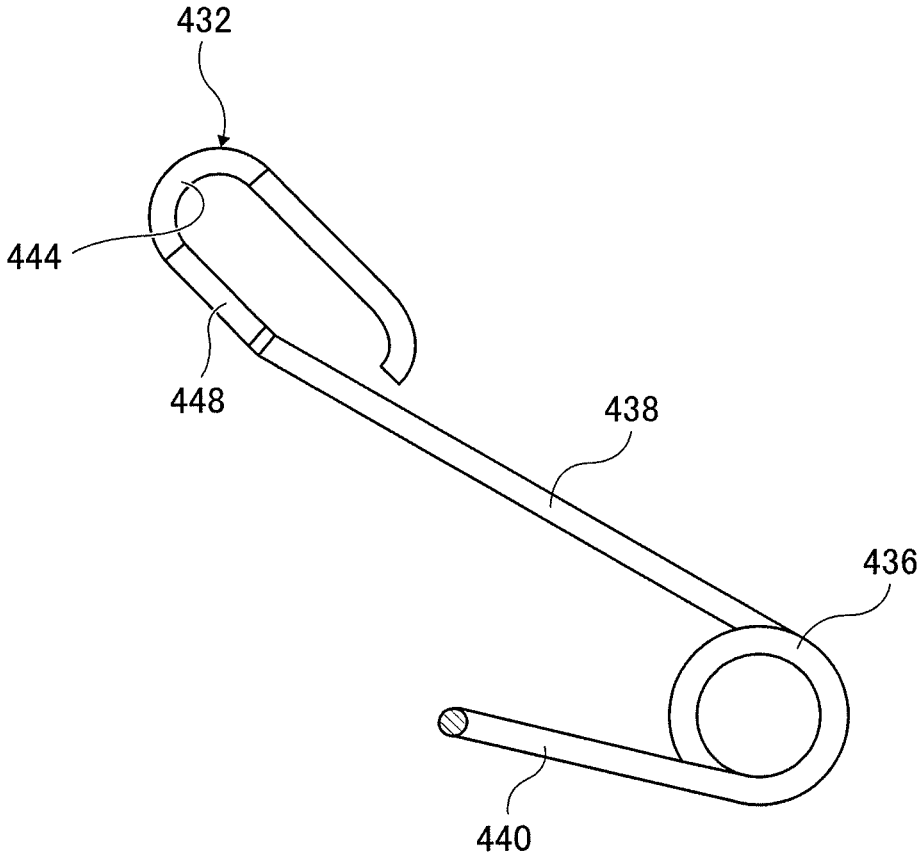
FIG. 5 is a cross-sectional view of the torsion coil spring in FIG. 4 along a line C-C in FIG. 4.

FIGS. 4 and 5 show the torsion coil spring 432. The torsion coil spring 432 has a wire material. More specifically, the torsion coil spring 432 is formed by curve-processing a wire member of an elastic-deformable material such as metal. Further, the torsion coil spring 432 has two coil-shaped winding parts 436 and two extending parts 438 extending from the respective winding parts 436 and a connecting part 440 connecting the two winding parts 436.

Further, the torsion coil spring 432 has a folded part 448 folded from the extending parts 438 toward the side of the guide surface 462 (see FIG. 8) to be described later in a status where it is attached to the conveyance device main body 402 (see FIG. 3).

Further, a part on the opposite side to the winding part 436 of the folded part 448 is bended in U-shape, thus forms a bended part 444. The bended part 444 has an inner diameter greater than an outer diameter of a rotation shaft of the shaft 424 in the driven roller 420. The shaft 424 of the driven roller 420 or the like is inserted in the bended part 444, and as the shaft 424 of the driven roller 420 is inserted into the bended part 444, the driven roller 420 is supported with the torsion coil spring 432. At this time, the folded part 448 and the shaft 424 of the driven roller 420 are in contact with each other, and the shaft 424 is supported with the torsion coil spring 432 (see FIG. 8). It may be arranged such that when the conveyance device 400 is assembled, the torsion coil spring 432 and the driven roller 420 are attached to the conveyance device main body 402 in a status where the driven roller 420 is previously inserted in the bended part 444.

Figure 6:
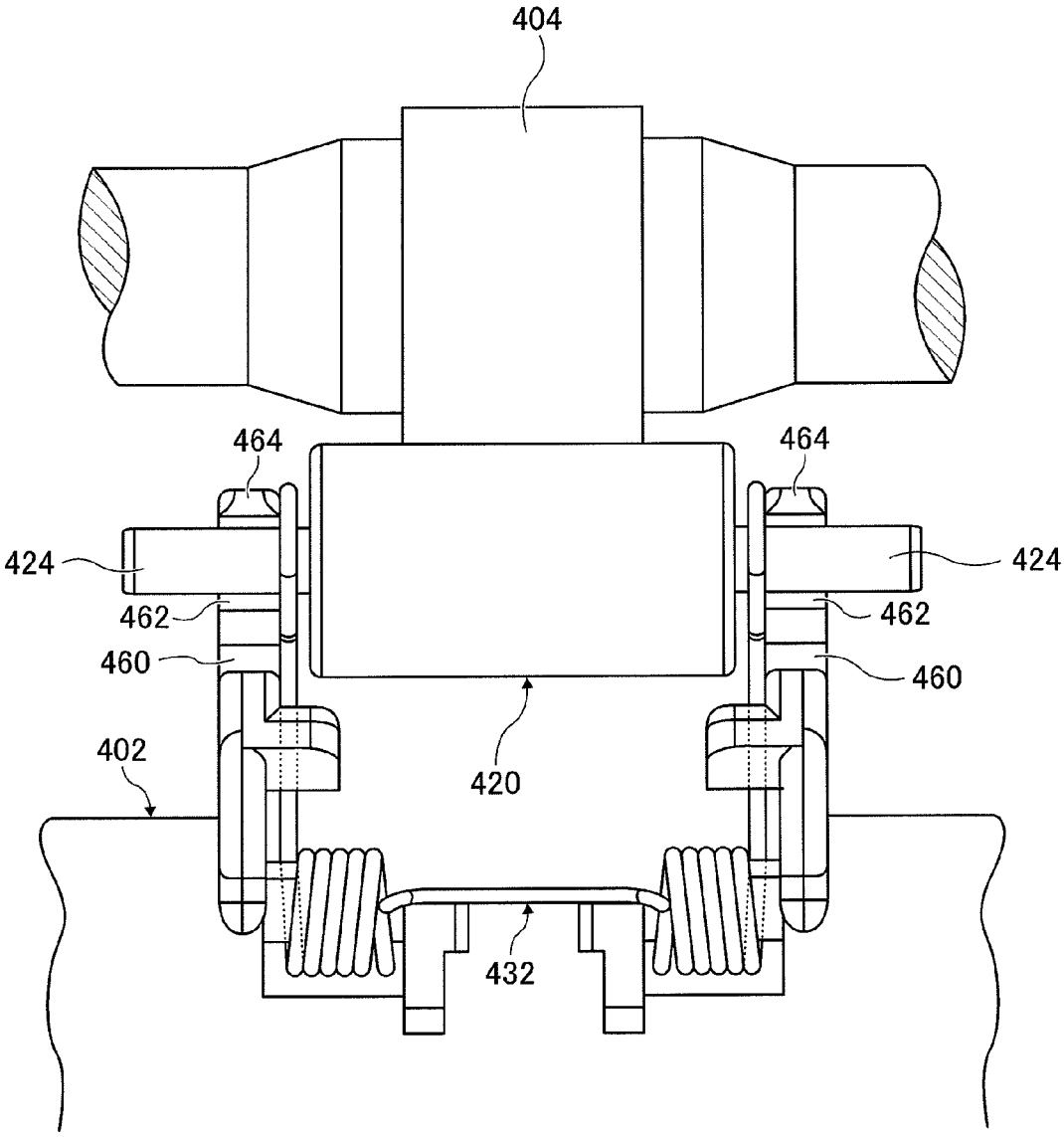
FIG. 6 is a partially enlarged rear view of the conveyance device shown in FIG. 3.
Figure 7:
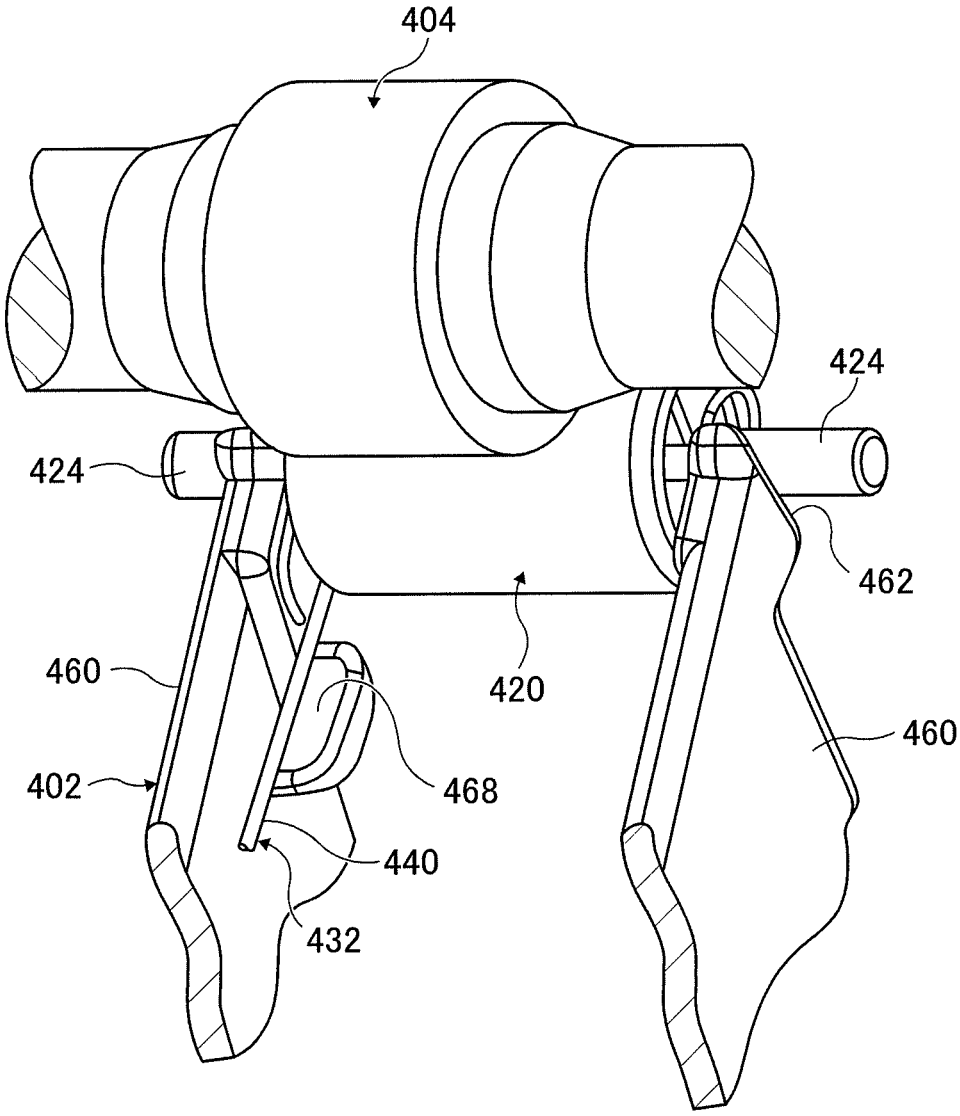
FIG. 7 is a partially enlarged perspective view of the conveyance device shown in FIG. 3.
Figure 8:
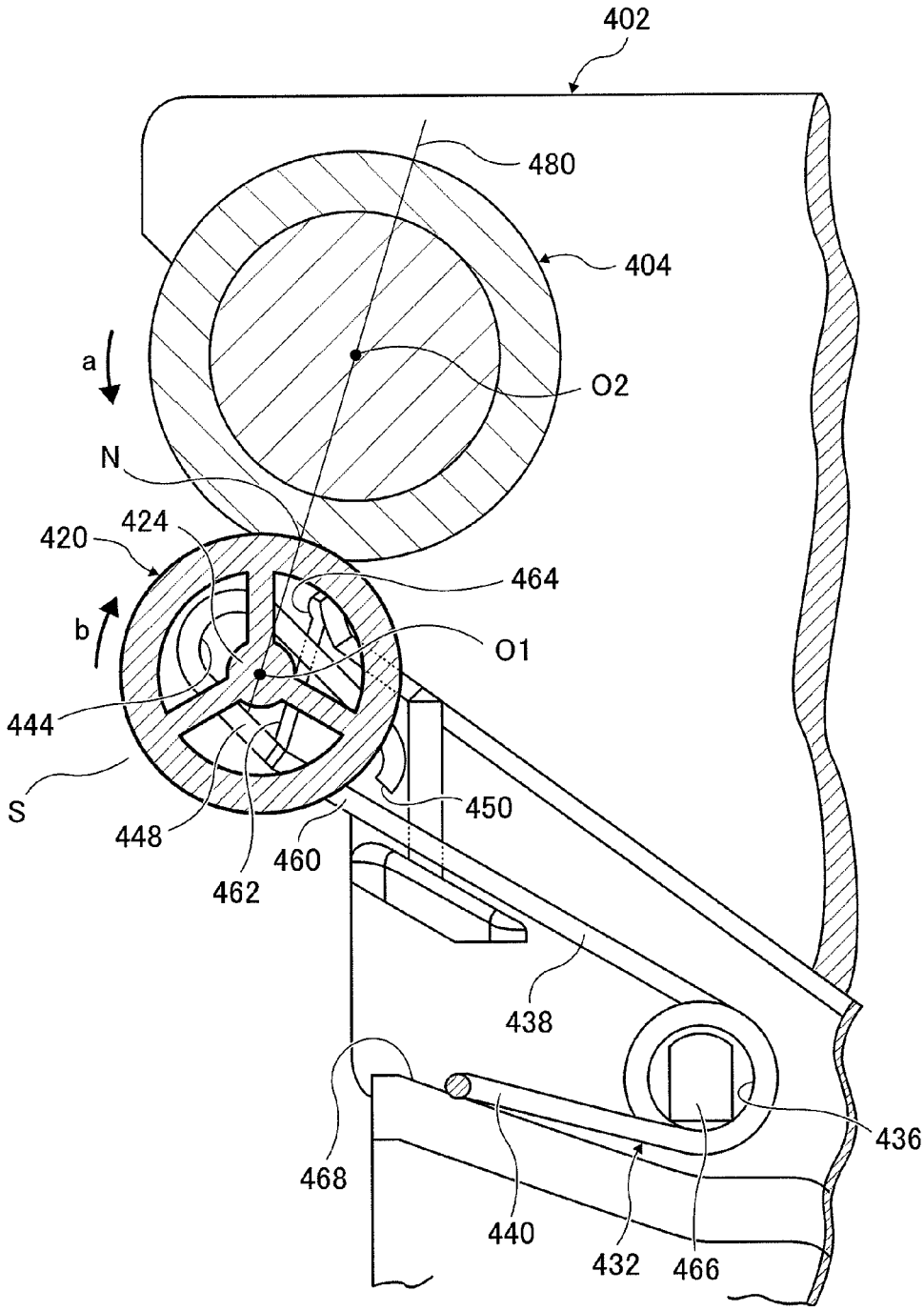
FIG. 8 is a partially enlarged cross-sectional view of the conveyance device shown in FIG. 3 along a plane B-B in FIG. 3.

FIGS. 6 to 8 show an enlarged part of the conveyance device 400. As shown in FIGS. 6 to 8, the conveyance device main body 402 is provided with a projection member 460, which is projected toward the rear side (left side in FIG. 1) and which is a plate member, in two positions with respect to the respective driven rollers 420. Among these eight projection members 460, adjacent two projection members 460 are used for positioning of one driven roller 420. The projection members 460 are respectively provided with the guide surface 462.

The guide surface 462, provided on the upstream side from the shaft 424 of the driven roller 420 in the sheet conveyance direction, is used as an example of a guide part to guide the driven roller 420 toward the driving roller 404. Further, the guide surface 462 is formed such that the shaft 424 of the driven roller 420 is guided toward the rotation center O2 of the driving roller 404.

A projection 464 for regulation is formed in an upper end of the guide surface 462. The projection 464 is projected from the guide surface 462 toward a virtual surface 480 including the rotation center O1 of the driven roller 420 and the rotation center O2 of the driving roller 404. The projection 464 regulates movement of the shaft 424 over the projection 464 to the driving roller 404 side, thus regulates movement of the driven roller 420 to the driving roller 404 side.

The space S, which is provided in the discharge part 14 (see FIG. 1) and which allows free fall of the rear end of a print sheet in a sheet discharge direction is formed in a part opposite to the guide surface 462. The rear end of the print sheet passed through the contact position N freely falls in the space S, and the rear end of the print sheet moves away from the contact position N. Accordingly, this rear end is hardly brought into contact with the end of the next print sheet which passes through the contact position N following the previous print sheet the rear end of which has freely fallen in the space S. Therefore, the print sheet the rear end of which has fallen and the print sheet conveyed next do not interfere with each other.

The guide surface 462 is a flat surface. Accordingly, the driven roller 420 is guided toward the driving roller 404 while it is moved along the guide surface 462.

Further, the guide surface 462 is approximately parallel to the virtual surface 480 including the rotation center O1 of the driven roller 420 and the rotation center O2 of the driving roller 404. Note that "approximately parallel" means that it is parallel as a design value, and it allows shifts due to errors in shape, size and the like caused in manufacture of the driving roller 404, the driven roller 420 and the conveyance device main body 402, and errors caused in installation of the driving roller 404, the driven roller 420 and the torsion coil spring 432 in the conveyance device main body 402. Since the guide surface 462 is approximately parallel to the virtual surface 480, the driven roller 420 is guided toward the driving roller 404 while it is moved in a direction from the rotation center O1 to the rotation center O2 along the guide surface 462.

Further, since the guide surface 462 is parallel to the virtual surface 480, even when the driven roller 420 is moved in a direction away from driving roller 404 by conveyance of a bold sheet or the like, the contact position N is not changed. Note that when a print sheet or the like exists between the driving roller 404 and the driven roller 420, the driving roller 404 and the driven roller 420 are not in contact with each other, in a narrow sense; however, even when a print sheet exists, it is assumed that these members are in contact, and the term "contact position N" or the like is used.

Further, as indicated with an arrow a in FIG. 8, the guide surface 462 is provided in a position such that, during rotation of the driving roller 404 in a direction to pull a print sheet inside the conveyance device main body 402, a force to press the driven roller 420 against the guide surface 462 is increased in accordance with rotation of the driven roller 420 indicated with an arrow b in FIG. 8. That is, in the present exemplary embodiment, when the driving roller 404 is rotated in the arrow a direction and the driven roller 420 is rotated in the arrow b direction, the driven roller 420 is moved along the guide surface 462 in a direction to come close to the driving roller 404, and the force to press the driven roller 420 against the guide surface 462 is increased.

Further, the guide surface 462 is provided on the downstream side from the driven roller 420 in the direction to pull a print sheet from the side of the discharge part 14 (see FIG. 1). Accordingly, when the print sheet is pulled, the driven roller 420 receives a force from the print sheet, and with this force, the driven roller 420 is pressed against the guide surface 462. Accordingly, when the print sheet is pulled from the discharge part 14 side, the driven roller 420 is pressed against the guide surface 462 with a strong force in comparison with a case where the print sheet is discharged to the discharge part 14.

Further, as shown in FIGS. 6 to 8, in the torsion coil spring 432, the inner diameter of the bended part 444 is greater than the outer diameter of the shaft 424 of the driven roller 420. In the bended part 444, the movement of the driven roller 420 in a direction to reduce the elastic force of the torsion coil spring 432 (leftward in FIG. 8) is relatively easily made. Accordingly, when a jammed print sheet is to be removed by forcibly pulling the print sheet to the discharge part 14 side, the driven roller 420 is moved in the bended part 444. Further, the driven roller 420 moves against the pressing force of the torsion coil spring 432, and the contact between the driven roller 420 and the driving roller 404 is released. Further, when the print sheet is violently pulled out, there is the fear of removal of the driven roller 420 from the torsion coil spring 432. However, since the distance between an end 450 of the torsion coil spring 432 on the bended part 444 side and the extending part 438 is shorter than the outer diameter of the shaft 424, the removal of the shaft 424 from the bended part 444 can be prevented.

Further, the movement of the driven roller 420 is regulated with the bended part 444 of the torsion coil spring 432 in the direction to discharge a print sheet to the discharge part 14. Accordingly, when the print sheet is to be removed by pulling the print sheet out to the discharge part 14 side and at least a part of the driven roller 420 is moved to be away from the driving roller 404, the movement of the driven roller 420 is regulated within a predetermined range.

Further, as shown in FIGS. 6 to 8, in the torsion coil spring 432, the folded part 448 is in contact with the shaft 424 of the driven roller 420.

Further, as shown in FIGS. 6 to 8, the torsion coil spring 432, held between adjacent two projection members 460, is attached to the conveyance device main body 402. More specifically, the projection members 460 have an attachment projection 466 for attachment of the torsion coil spring 432 and a support member 468 to support the torsion coil spring 432 from the lower side. The torsion coil spring 432 is attached to the conveyance device main body 402 in a status where the attachment projection 466 is inserted into the winding part 436 and the connecting part 440 is supported with the support member 468 from a lower position in the gravitational direction.

Figure 9:
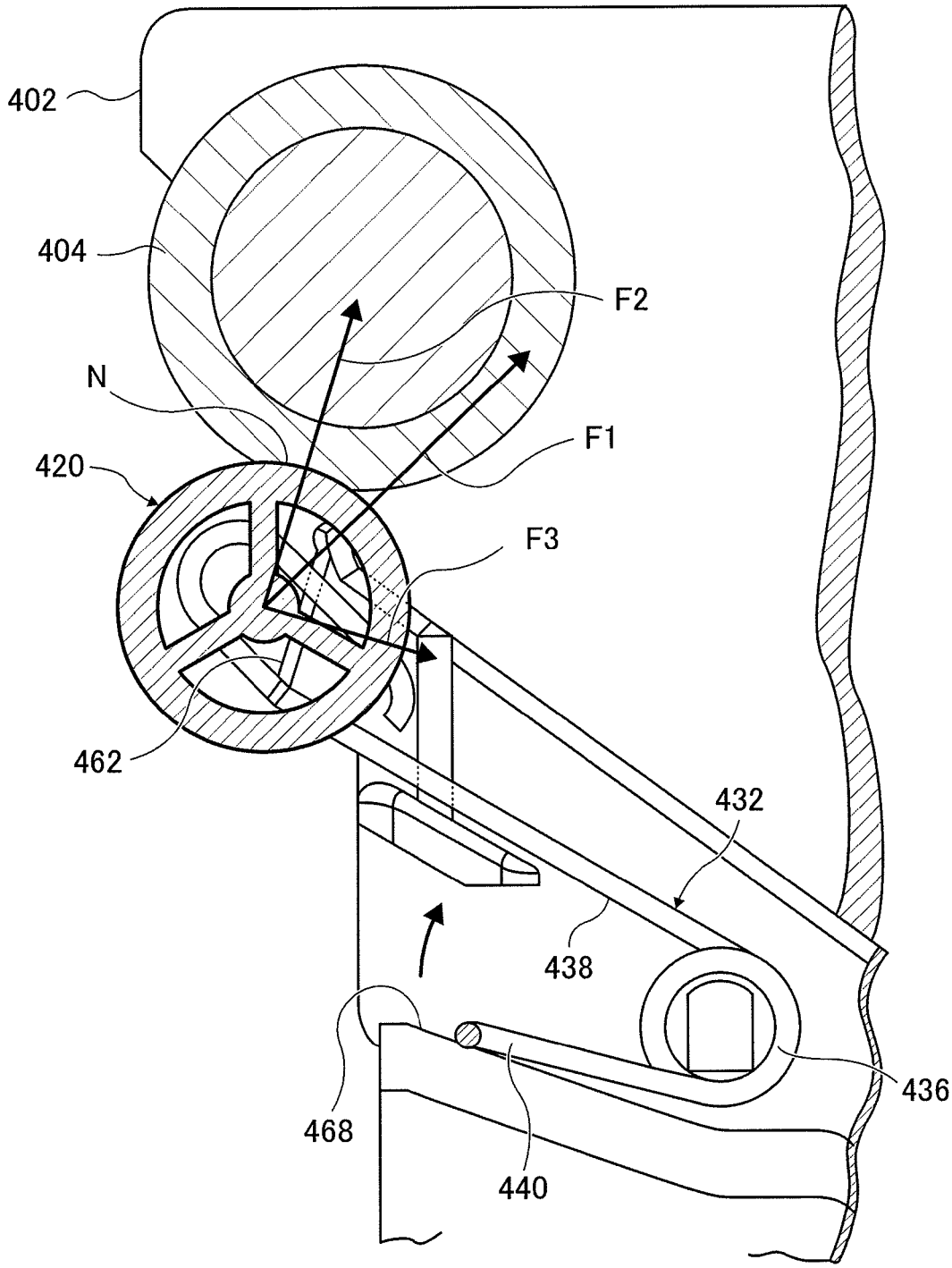
FIG. 9 is an explanatory view of a force applied to a driven roller from the torsion coil spring shown in FIG. 4.

FIG. 9 is an explanatory view of the force applied to the driven roller 420 from the torsion coil spring 432. As shown in FIG. 9, the torsion coil spring 432 is attached to the conveyance device main body 402 in a status where the winding parts 436 are deformed so as to bring the connecting part 440 and the extending parts 438 close to each other, and the movement of the connecting part 440 is regulated with the support member 468. Accordingly, in a status where the torsion coil spring 432 is attached to the conveyance device main body 402, the extending parts 438 are deformed so as to be away from the connecting part 440.

Then, as the extending parts 438 of the torsion coil spring 432 are deformed so as to be away from the connecting part 440, the driven roller 420 is pressed with the torsion coil spring 432 with a force F1. As shown in FIG. 9, the direction of the force F1 is between the contact position N between the driving roller 404 and the driven roller 420 and the guide surface 462. Further, as the driven roller 420 is pressed with the torsion coil spring 432 with the force F1, the driven roller 420 is pressed against the driving roller 404 with a force F2, and further pressed against the guide surface 462 with a force F3. That is, the torsion coil spring 432 of the pressing mechanism 430 presses the driven roller 420 toward the driving roller 404 and the guide surface 462. Note that the direction of the force is changed and the component forces to the driving roller 404 and the driven roller 420 are changed by changing the degree of folding of the folded part 448.

Figure 10:
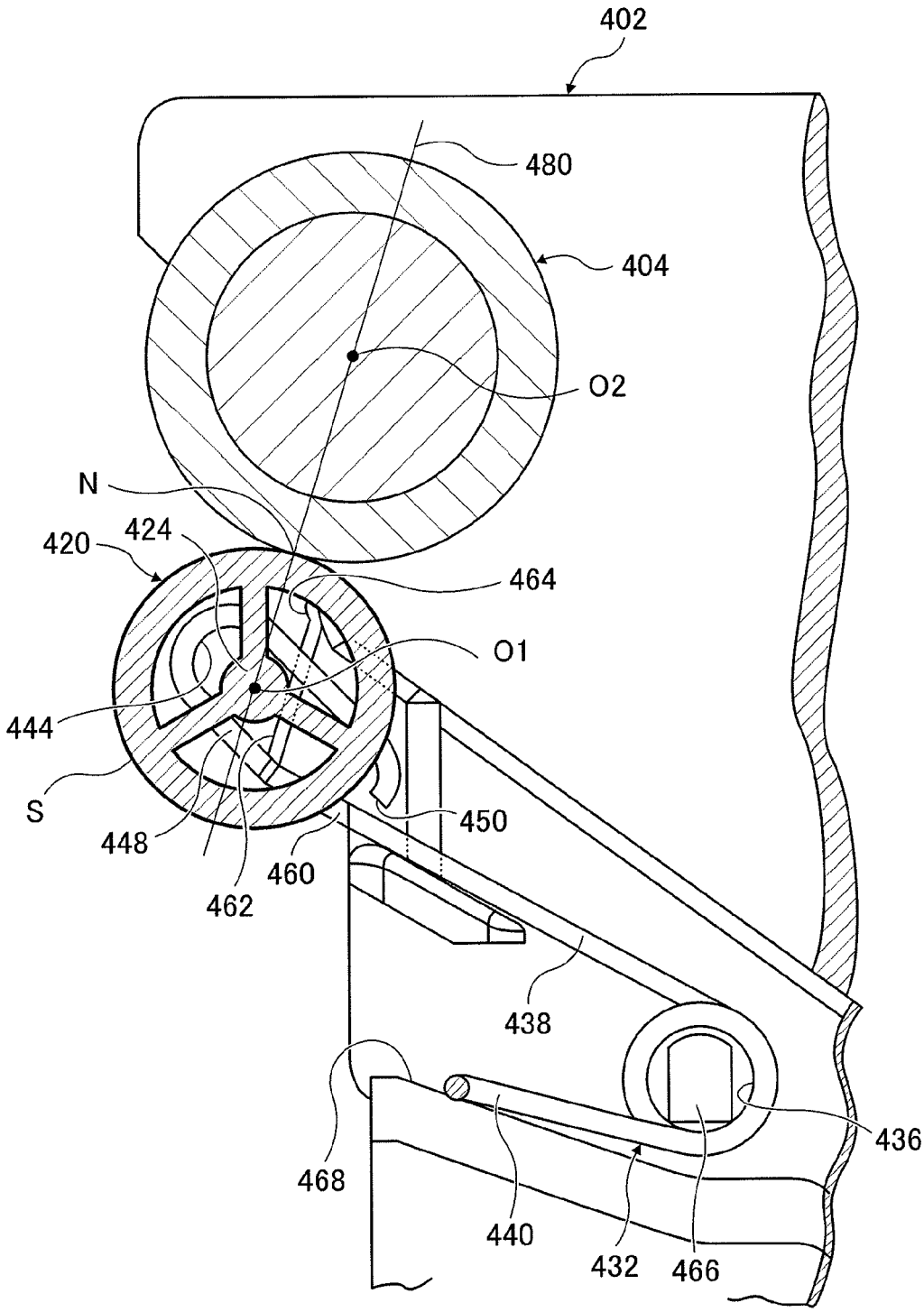
FIG. 10 is a partially enlarged cross-sectional view of the conveyance device shown in FIG. 3 along a plane B-B in FIG. 3, showing a status where the driven roller is moved away from a driving roller from the position shown in FIG. 8.

FIG. 10 is a partially enlarged view of the conveyance device 400 in a status where the driven roller 420 is moved away from the driving roller 404 from the position shown in FIG. 8. When a print sheet is held in the contact position N or the print sheet jammed in the contact position N is pulled out, the driven roller 420 is moved from the position shown in FIG. 8 to the position shown in FIG. 10. Further, when the rear end of the print sheet is passed through the contact position N or when the print sheet jammed in the contact position N is removed, the driven roller 420 is moved from the side shown in FIG. 10 to the status shown in FIG. 8.

As described above, in the conveyance device 400 according to the present exemplary embodiment, the guide surface 462 is approximately in parallel to the virtual surface 480 including the rotation center O1 of the driven roller 420 and the rotation center O2 of the driving roller 404, and the guide surface 462 is formed such that the shaft 424 of the driven roller 420 is guided toward the rotation center O2 of the driving roller 404. As it is understood by referring to FIG. 8 and FIG. 10, the driven roller 420 is moved such that the rotation center O1 moves on the virtual surface 480. Accordingly, even when the driven roller 420 is moved, the position of the contact position N where the driving roller 404 and the driven roller 420 are in contact with each other is not changed.

Figure 11:
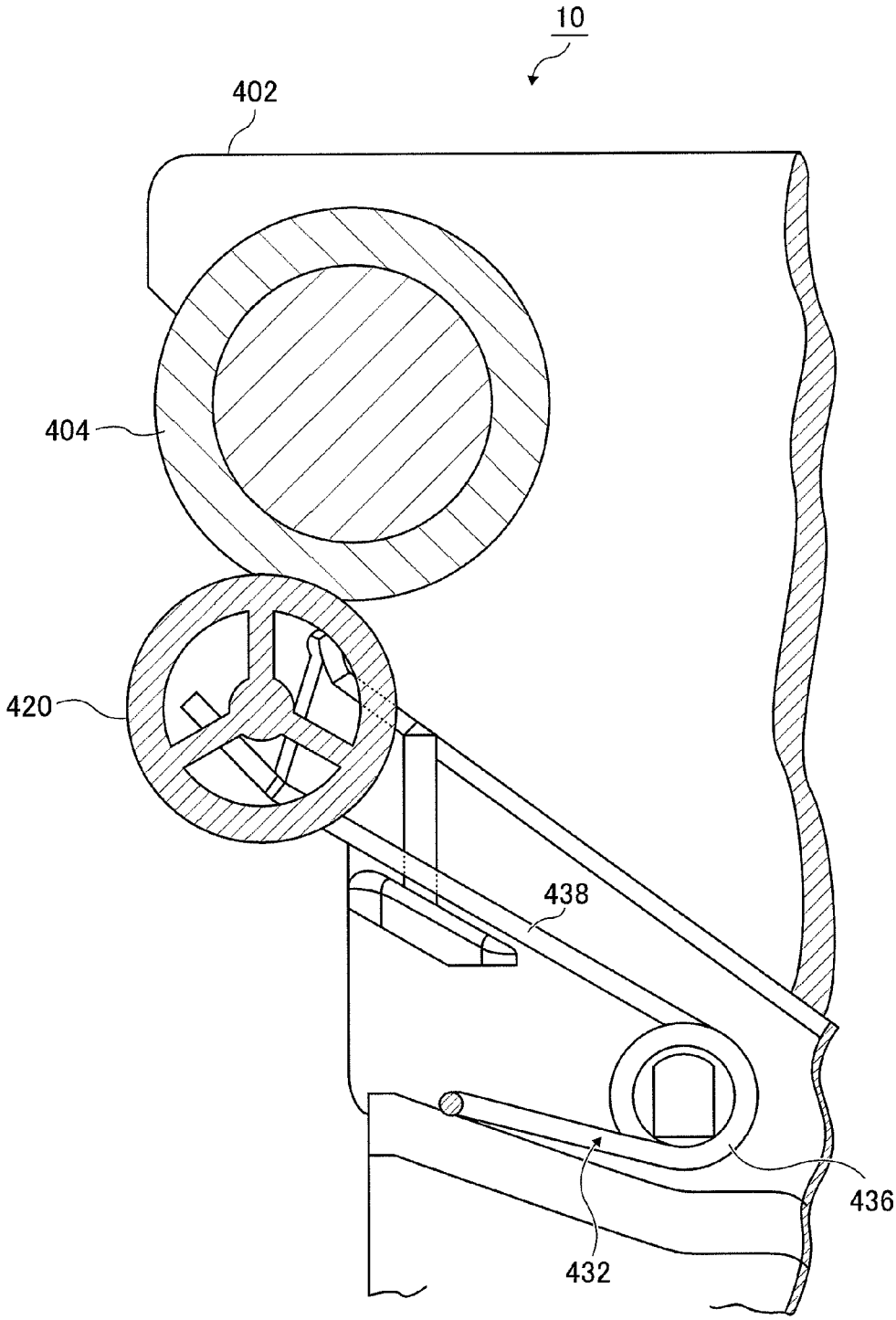
FIG. 11 is a partially enlarged cross-sectional view of the conveyance device of the image forming apparatus according to a second exemplary embodiment of the present invention.

FIG. 11 shows the image forming apparatus 10 according to a second exemplary embodiment of the present invention.

In the image forming apparatus 10 according to the above-described first exemplary embodiment, the torsion coil spring 432 has two winding parts 436, two extending parts 438 extending from the respective winding parts 436, the connecting part 440 connecting the two winding parts 436, and the bended part 444 in which the driven roller 420 is inserted. On the other hand, in the image forming apparatus 10 according to the second exemplary embodiment, the extending part 438 does not have the bended part 444 in which the driven roller 420 is inserted. Note that explanations of elements corresponding to those in the image forming apparatus 10 according to the above-described first exemplary embodiment will be omitted.

Figure 12:
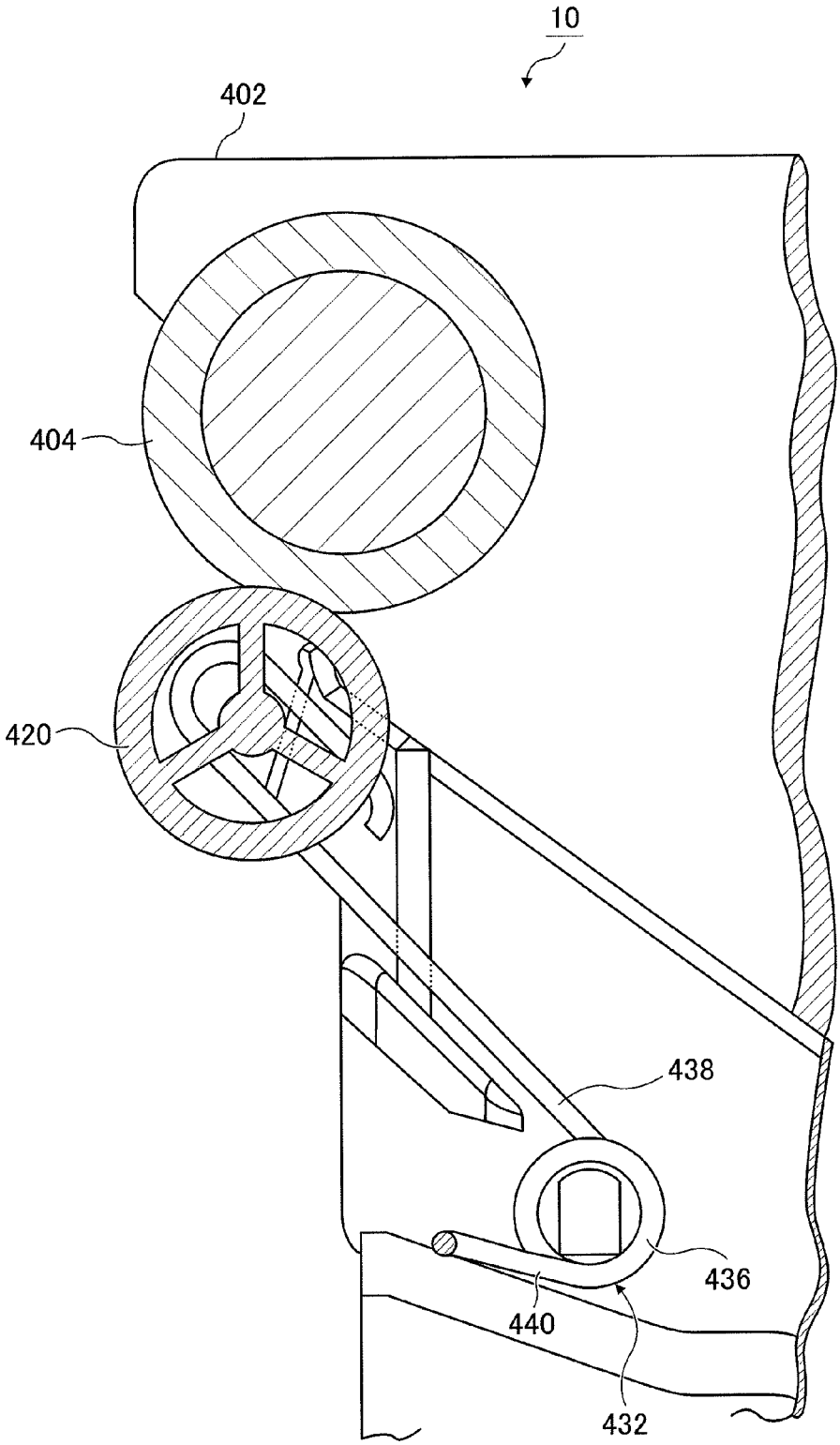
FIG. 12 is a partially enlarged cross-sectional view of the conveyance device of the image forming apparatus according to a third exemplary embodiment of the present invention.

FIG. 12 shows the image forming apparatus 10 according to a third exemplary embodiment of the present invention.

In the image forming apparatus 10 according to the above-described first exemplary embodiment, the torsion coil spring 432 has two winding parts 436, two extending parts 438 extending from the respective winding parts 436, the connecting part 440 connecting the two winding parts 436, and the folded part 448 folded from the extending parts 438 toward the guide surface 462. On the other hand, in the image forming apparatus 10 according to the third exemplary embodiment, the torsion coil spring 432 does not have the folded part 448. Note that explanations of elements corresponding to those in the image forming apparatus 10 according to the above-described first exemplary embodiment will be omitted.

Figure 13:
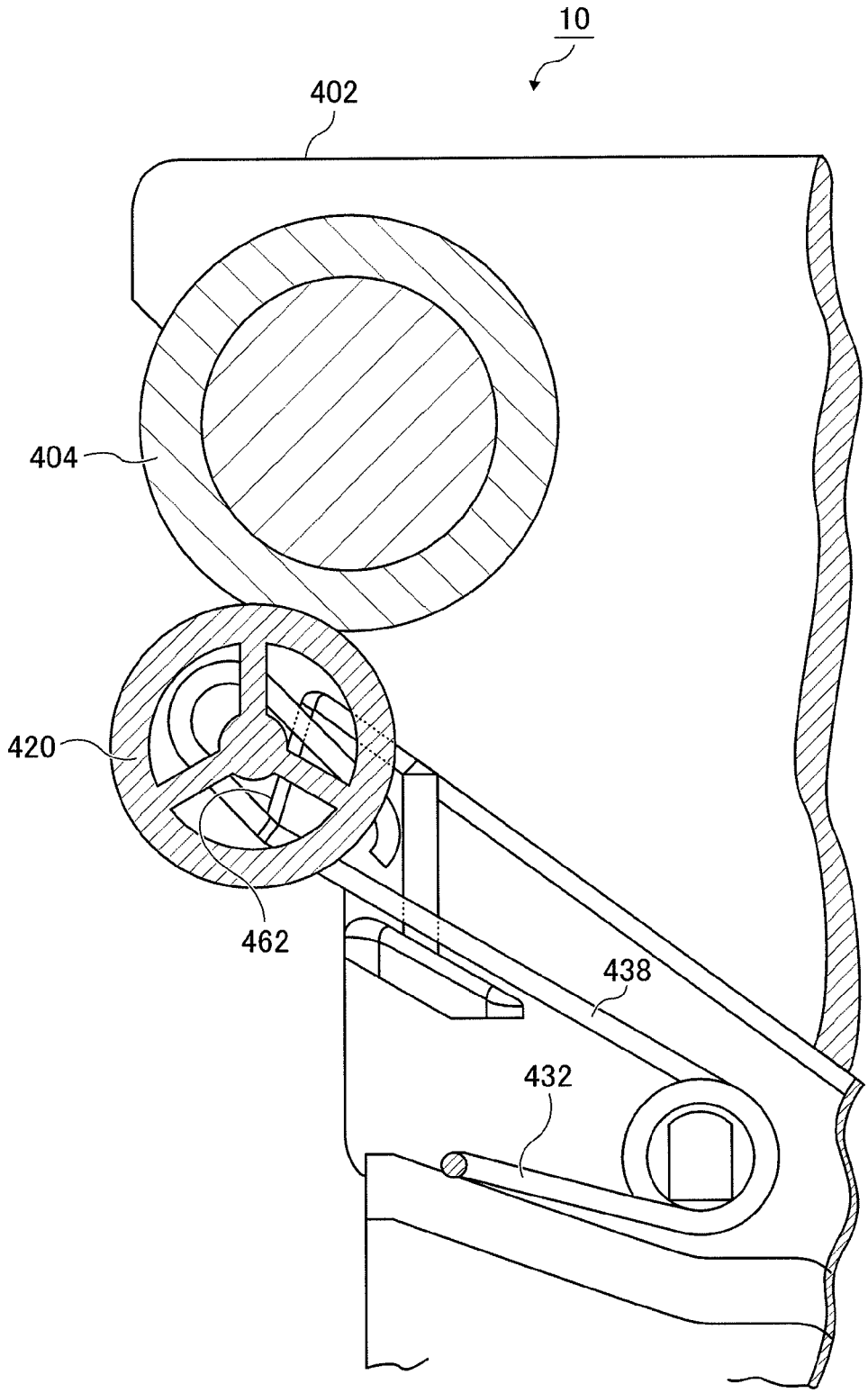
FIG. 13 is a partially enlarged cross-sectional view of the conveyance device of the image forming apparatus according to a fourth exemplary embodiment of the present invention.

FIG. 13 shows the image forming apparatus 10 according to a fourth exemplary embodiment of the present invention.

In the image forming apparatus 10 according to the above-described first exemplary embodiment, the projection 464 is formed at the upper end of the guide surface 462. On the other hand, in the image forming apparatus 10 according to the fourth exemplary embodiment, the projection 464 is not formed. Note that explanations of elements corresponding to those in the image forming apparatus 10 according to the above-described first exemplary embodiment will be omitted.

Figure 14:
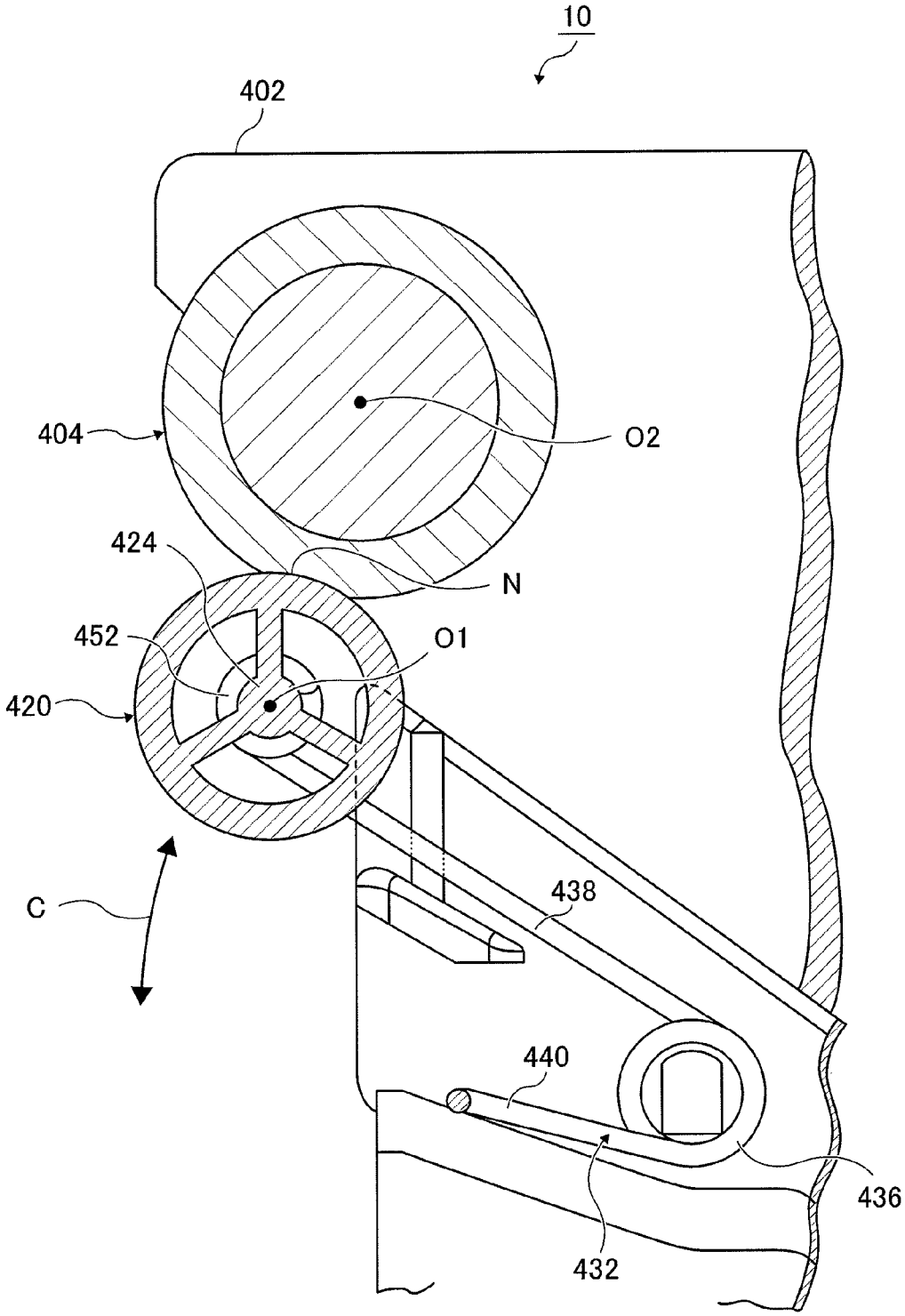
FIG. 14 is a partially enlarged cross-sectional view of the conveyance device of an image forming apparatus according to a comparative example.

FIG. 14 shows the image forming apparatus 10 according to a comparative example.

The image forming apparatus 10 according to the above-described first to fourth exemplary embodiments has the guide surface 462, provided on the upstream side from the shaft 424 of the driven roller 420 in the sheet conveyance direction, to guide the driven roller 420 toward the driving roller 404, and the torsion coil spring 432 brings the shaft 424 of the driven roller 420 into contact with the guide surface 462 and supports the driven roller 420 along with the guide surface 462. On the other hand, the image forming apparatus 10 according to this comparative example does not have the guide surface 462, and the driven roller 420 is supported only with the torsion coil spring 432.

Further, in the image forming apparatus 10 according to the above-described first to fourth exemplary embodiments, the bended part 444 is formed in the torsion coil spring 432, and the shaft 424 is positioned in the bended part 444 such that the driven roller 420 is supported with the torsion coil spring 432. Accordingly, as the shaft 424 moves in the bended part 444, the driven roller 420 is movable with respect to the torsion coil spring 432. On the other hand, in the image forming apparatus 10 according to this comparative example, the torsion coil spring 432 has a ring member 452 in place of the bended part 444 and the shaft 424 is inserted in the ring member 452 so as to support the driven roller 420.

The ring member 452 is formed by bending the end of a wire material forming the torsion coil spring 432 into a ring shape. Further, the inner diameter of the ring member 452 is slightly greater than the outer diameter of the shaft 424. Accordingly, although the driven roller 420 is rotatable while being supported with the torsion coil spring 432, it is not movable to change the position with respect to the torsion coil spring 432.

Further, in the image forming apparatus 10 according to the above-described first to fourth exemplary embodiments, as the driven roller 420 is guided with the guide surface 462, the driven roller 420 is moved so as to move the rotation center O1 of the driven roller 420 in the virtual surface 480 including the rotation center O1 and the rotation center O2 of the driving roller 404. Accordingly, in the image forming apparatus 10 according to the above-described first to fourth exemplary embodiments, even when the driven roller 420 is moved, the position of the contact position N in which the driving roller 404 and the driven roller 420 are in contact with each other is not changed. On the other hand, in the image forming apparatus 10 according to the comparative example, as the torsion coil sprint 432 is deformed such that the extending parts 438 come closer to the connecting part 440 or the extending parts 438 move away from the connecting part 440, the driven roller 420 is moved. Accordingly, in the image forming apparatus 10 according to this comparative example, the driven roller 420 is moved to circulate as indicated with an arrow c in FIG. 14, and the position of the contact position N between the driven roller 420 and the driving roller 404 is changed with the movement of the driven roller 420.

Further, in the image forming apparatus 10 according to the first to fourth exemplary embodiments, the torsion coil spring 432 brings the shaft 424 of the driven roller 420 into contact with the guide surface 462, and supports the driven roller 420 along with the guide surface 462. On the other hand, in the image forming apparatus 10 according to this comparative example, the driven roller 420 is supported only with the torsion coil spring 432. Accordingly, in comparison with the image forming apparatus 10 according to the above-described first to fourth exemplary embodiments, in the image forming apparatus 10 according to the comparative example, it is difficult to improve the accuracy of positioning of the driven roller 420 with respect to the driving roller 404.

In the above-described respective exemplary embodiments, an electrophotographic type image holder to form a multi-color image is adopted. However, image holders of various printing types such as an ink-jet type image holder, a thermal-transfer type image holder, an offset printing type image holder other than the electrophotographic type image holder may be used. Further, in addition to the image holder to form a multi-color image, a monochrome type image holder may be used.

In the above description, the conveyance device to convey a recording medium such as a print sheet applied to an image forming apparatus is described as exemplary embodiments. However, the present invention is applicable to conveyance devices to convey other conveyed materials than the recording medium, and also applicable to other devices than the conveyance device applied to the image forming apparatus. For example, the present invention is applicable to a conveyance device to convey bank bills such as an ATM (Automated Teller Machine). Further, the present invention is applicable to a conveyance device to convey a railway ticket, a prepaid card or the like in an automatic ticket gate.

As described above, the present invention is available at least in an image forming apparatus such as a printer, a facsimile machine and a copier, and a conveyance device applicable to these image forming apparatuses.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming part that forms an image; and a conveyance device that conveys at least one of a recording medium discharged from the image forming part and a recording medium supplied to the image forming device, the image forming part comprising:

a rotary member that rotates;

a driven member that is driven by the rotary member and conveys a recording medium while holding the recording medium between the driven member and the rotary member;

a guide surface, provided on one side of the a rotary shaft of the driven member in a perpendicular direction to a longitudinal direction of the rotary shaft of the driven member, such that the guide surface is in contact with the rotary shaft of the driven member, guides the rotary shaft of the driven member toward the rotary member and is formed so as to be parallel to a virtual surface connecting a rotation center of the driven member with a rotation center of the rotary member;

a support member that brings the rotary shaft of the driven member into contact with the guide surface, and along with the guide surface, supports the rotary shaft, wherein the support member is in contact with the rotary shaft of the driven member from a tilted direction with respect to a perpendicular surface of the guide surface, presses the rotary shaft of the driven member against the guide surface, presses the rotary shaft of the driven member toward the rotary member, and regulates a movement of the rotary shaft of the driven member in the opposite direction to the guide surface;

a discharge part to which a recording medium is discharged, wherein the driven member is the last member to convey a recording medium to the discharge part; and a space provided in the discharge part which allows free fall of the rear end of a recording medium in a recording medium discharge direction.

2. The image forming apparatus according to claim 1, wherein the rotary shaft of the driven member is positioned in a bended part formed in the support member, and an inner diameter of the bended part is greater than an outer diameter of the rotary shaft of the driven member.

3. The image forming apparatus according to claim 1, wherein the support member has:

a coil-shaped winding part;

an extending part that extends from the winding part; and a folded part folded from the extending part toward the guide part, and the folded part and the rotary shaft of the driven member, in contact with each other, support the rotary shaft.

4. The image forming apparatus according to claim 1, wherein a projection is projected from the guide part toward the virtual surface connecting the rotary shaft of the driven member with a rotary shaft of the rotary member.

5. The image forming apparatus according to claim 2, wherein the bended part forms a slot that is tilted with respect to the guide surface.

6. The image forming apparatus according to claim 1, wherein a plurality of the driven members are arranged in the longitudinal direction of the driven member and each of driven members are supported by a plurality of the different support members.

7. The image forming apparatus according to claim 1, wherein the guide part is formed so as to guide the rotary shaft of the driven member toward the rotation center of the rotary member;

the rotary member rotates forward to convey a recording medium discharged from the image forming part and rotates in reverse to convey a recording medium discharged from the image forming part; and the guide surface is provided in a position such that, during the reverse rotation of the rotary member, the driven member is pressed against the guide surface.

* * * * *